United States Patent [19]

Bruckmann

[11] Patent Number: 4,581,203

[45] Date of Patent: Apr. 8, 1986

[54] PROCESS FOR THE MANUFACTURE OF FERROSILICON OR SILICON ALLOYS CONTAINING STRONTIUM

[75] Inventor: Heinz Bruckmann, Tacherting, Fed. Rep. of Germany

[73] Assignee: SKW Trostberg Aktiengesellschaft, Trostberg, Fed. Rep. of Germany

[21] Appl. No.: 623,948

[22] Filed: Jun. 25, 1984

[30] Foreign Application Priority Data

Jun. 28, 1983 [DE] Fed. Rep. of Germany ..... 3323203

[51] Int. Cl.[4] ..... C22C 1/06; C22C 28/00

[52] U.S. Cl. ..... 420/578; 420/590; 75/129

[58] Field of Search ..... 420/590, 578; 423/324; 75/129, 130 R

[56] References Cited

U.S. PATENT DOCUMENTS

| | | | |
|---|---|---|---|
| 2,266,122 | 12/1941 | Kinzel | 420/578 |
| 3,374,086 | 3/1968 | Guehring | 420/578 |
| 4,017,310 | 4/1977 | Downing et al. | 420/578 |

FOREIGN PATENT DOCUMENTS

| | | | |
|---|---|---|---|
| 2052927 | 5/1971 | Fed. Rep. of Germany | 420/575 |
| 4647 | 10/1908 | United Kingdom | 420/578 |
| 259933 | 12/1969 | U.S.S.R. | 420/578 |

*Primary Examiner*—L. Dewayne Rutledge
*Assistant Examiner*—Christopher W. Brody
*Attorney, Agent, or Firm*—Fred A. Keire

[57] ABSTRACT

A process is described for the manufacture of ferrosilicon or silicon alloys containing strontium and having a low aluminum and calcium content, in which a strontium compound is introduced together with an alkaline earth metal, an alkaline earth metal-containing alloy or calcium carbide as reducing agent into the molten ferrosilicon or silicon. The process is distinguished by low industrial expense and good strontium yields.

4 Claims, No Drawings

PROCESS FOR THE MANUFACTURE OF FERROSILICON OR SILICON ALLOYS CONTAINING STRONTIUM

The present invention relates to a process for the manufacture of ferrosilicon or silicon alloys containing strontium and having a low aluminium and calcium content, such as are described, for example, in DE-PS 14 33 429. Alloys of this type are used above all in the field of foundry work when manufacturing cast iron using lamellar, nodular or vermicular graphite or when manufacturing silicon-containing aluminium castings, the alloys being suitable for special inoculation problems owing to their special properties. Strontium-containing ferrosilicon alloys effectively suppress chill tendency and in this manner improve the structure and properties of the cast iron. Since, in certain circumstances, the elements aluminium and calcium increase the formation of defects in the casting, the aluminium and calcium content in the alloy should be kept as low as possible.

From DE-PS 15 08 273 there is known a process for the manufacture of strontium-containing ferrosilicon having a low calcium content in an arc furnace, which process comprises two stages. First of all, a master alloy containing from 15 to 55% strontium and from 40 to 75% silicon is prepared from quartzite, celestine having a ratio of strontium to calcium of at least 10:1 and a carbon-containing reducing agent and the master alloy is then added to molten ferrosilicon in such an amount that the resulting alloy has a strontium content of at least 0.5%. Although the yield with regard to the strontium is good, the two-stage process is industrially rather expensive and the loss of heat during the transferring operation is unfavourable with regard to energy.

To avoid these disadvantages, an attempt was made according to U.S. Pat. No. 4,017,310 to manufacture strontium-containing alloys of this type in a one-stage process by introducing a strontium compound, such as, for example, the oxide, carbonate or sulphate, and carbon into the molten ferrosilicon or silicon. In order, however, to achieve an optimum strontium yield, the strontium compound must be pelletised together with the carbon, which, however, gives rise to additional operating and investment costs.

The problem underlying the present invention is, therefore, to develop a process for the manufacture of ferrosilicon or silicon alloys containing strontium and having a low aluminium and calcium content which does not have the disadvantages mentioned and which ensures good strontium yields despite low industrial expense.

This problem is solved according to the invention by introducing the strontium compound together with an alkaline earth metal, an alkaline earth metal-containing alloy or calcium carbide as reducing agent into the molten ferrosilicon or silicon. Surprisingly, it has been found that, when using the reducing agents according to the invention, the strontium yield is good and that, even when using calcium carbide, the calcium content in the alloy is relatively low.

In the process according to the invention, the ferrosilicon, which has a silicon content of from 30 to 90%, or the silicon is melted in the customary industrial devices, such as, for example, in an induction furnace or in a low shaft furnace.

Preferred compositions of the ferrosilicon are FeSi 50 and FeSi 75 having a silicon proportion of between 40 and 65% and between 65 and 80%, respectively. Subsequently, the smelt can be subjected to a short oxygen treatment and the slag can be removed. The mixture of strontium compound and reducing agent is then introduced into the smelt and the reaction mixture is left for from 1 to 30 minutes, especially from 5 to 15 minutes, at a temperature of from 1300° to 1500° C. In this manner, strontium values of from 0.1 to 20% may occur in the alloy. Suitable strontium compounds are, in principle, all reducible derivatives of strontium, but it is preferable to use compounds containing oxygen, such as, for example, the oxide, carbonate, hydroxide or sulphate of strontium.

Suitable reducing agents are, above all, metals or alloys of alkaline earth metals. In this respect, calcium, magnesium, calcium-silicon and ferrosilicon-magnesium have proved especially advantageous.

In addition to these alkaline earth metals or the alloys thereof, calcium carbide, such as is commercially available as an industrial product having a content of from 70 to 80% $CaC_2$, is also suitable for the manufacture of the alloys concerned, although it contains additional calcium-containing compounds, such as, for example, calcium oxide, as secondary constituents.

With regard to the ratios by weight of strontium compound to reducing agent, the highest yields of strontium can be achieved if approximately stoichiometric amounts of the reactants are used. If the proportion of strontium compound is larger than this, the yields naturally decrease owing to the lack of reducing agent, while if the proportion of calcium-containing reducing agent is too high, the calcium proportion in the alloy exceeds the desired value.

With the aid of the process according to the invention, it is possible to manufacture ferrosilicon or silicon alloys containing strontium using industrially relatively simple means and without too great an expenditure of energy, the process having special advantages owing to the good strontium yields and, at the same time, low calcium contents in the alloys.

The following Examples are intended to explain the invention in detail without, however, limiting it thereto.

EXAMPLE 1

10 kg of a ferrosilicon alloy (FeSi 75) having the following composition

Si: 79.2%
Fe: 16.6%
Al: 1.84%
Ca: 1.19%
Ti: 0.05%
C: not determined
Sr: <0.01% are melted in an induction furnace and subjected to an oxygen treatment for 15 minutes. After being left to stand for five minutes, the slag is drawn off, the alloy having the following analysis:

Si: 76.5%
Fe: 21.7%
Al: 0.48%
Ca: 0.06%
Ti: 0.07%
C: 0.06%
Sr: <0.1%

Subsequently, a mixture comprising 565 g of strontium carbonate and 353 g of industrial calcium carbide (73%)

is stirred into the smelt. After a reaction time of 15 minutes, the slag is drawn off from the alloy and the alloy is cast, the following final values being achieved in the alloy:

Si: 74.0%
Fe: 19.9%
Al: 0.56%
Ca: 1.2%
Ti: 0.06%
C: 0.48%
Sr: 2.4%

The yield of strontium is 72%.

EXAMPLE 2

10 kg of FeSi 75 are melted as in Example 1 in an induction furnace. After the treatment with oxygen and removal of the slag, a mixture of 400 g of strontium carbonate and 71.5 g of fine magnesium filings is introduced into the liquid alloy. The smelt is then left to stand for approximately 15 minutes before the slag is again drawn off from the alloy and the alloy is cast. After this treatment, the alloy has the following analysis:

Si: 76.5%
Fe: 21.0%
Al: 0.52%
Ca: 0.09%
Ti: 0.06%
C: 0.11%
Mg: 0.2%
Sr: 0.7%

The yield of strontium is 29.5%.

EXAMPLE 3

10 kg of FeSi are melted as in Example 1 in an induction furnace and subjected to an oxygen treatment for 15 minutes, the slag is drawn off and then a mixture of 400 g of strontium carbonate and 34 g of calcium-silicon having a particle size of less than 0.1 mm is added. After a reaction time of 15 minutes, the slag is drawn off from the alloy and the alloy is cast, the final alloy having the following analysis:

Si: 76.9%
Fe: 19.1%
Al: 0.89%
Ca: 0.38%
Ti: 0.06%
Sr: 1.0%

The yield, based on the strontium, is 42.1%

EXAMPLE 4

10 kg of FeSi 75 are melted in an induction furnace according to Example 1 and oxygen is blown into the melt for 15 minutes. After being left to stand for 5 minutes, the slag is removed and a mixture of 400 g of strontium carbonate and 1300 g of fine-grained FeSiMg 5 having the following composition is stirred into the smelt:

Fe: 40.5%
Si: 47.1%
Al: 1.41%
Mg: 5.5%
Ca: 2.9%
RE: 0.8%

(RE=rare earths)

After a treatment time of 15 minutes, the slag is drawn off and the alloy is cast, the alloy having the following analysis:

Fe: 25.0%
Si: 73.0%
Al: 0.35%
Ca: 0.09%
Ti: 0.06%
C: 0.22%
Mg: 0.2%
Sr: 0.4%

This corresponds to a strontium yield of 16.8%

EXAMPLE 5

8 kg of silicon metal having the following composition

Si: 99%
Ca: 0.01%
Al: 0.18%
Fe: 0.5%
C: not determined
Sr: <0.01% are melted in an induction furnace. Subsequently, the slag is removed and 5 kg of a mixture of 93% by weight of strontium carbonate and 8% by weight of industrial calcium carbide are introduced into the smelt. After a reaction time of 10 minutes, the slag is again removed, analysis of the alloy giving the following values:

Si: 85.4%
Fe: 0.9%
Al: <0.1%
Ca: 0.32%
Ti: 0.02%
C: 0.06%
Sr: 12.3%

The strontium yield is 48.1%.

I claim:

1. In a process for the manufacture of ferrosilicon or silicon alloys containing strontium and having a low aluminum and calcium content, wherein the improvement consists essentially of introducing into a molten ferrosilicon or silicon alloy bath a strontium compound together with an alkaline earth metal, an alkaline earth metal-containing alloy or calcium carbide as reducing agent, said reducing compound being in an amount about stoichiometrically related to the strontium compound, reducing said alloy and, after slag removal, recovering said alloy with increased strontium content, reduced aluminum content, and without substantial increase in calcium content or reduction in calcium content, and wherein said strontium introduction is in high yield based on introduced amount of strontium.

2. Process according to claim 1, wherein the strontium compound is the sulphate, carbonate, oxide or hydroxide of strontium.

3. Process according to claim 1, wherein the reducing agent is calcium, magnesium, calcium-silicon or ferrosilicon-magnesium.

4. Process according to claim 1, wherein about equal stoichiometric amount of reducing agent are used as based on the strontium compound.

* * * * *